US007794168B2

(12) United States Patent
Chang

(10) Patent No.: US 7,794,168 B2
(45) Date of Patent: Sep. 14, 2010

(54) QUANTITATIVE DISCHARGE STRUCTURE FOR BRUSHED COSMETIC JAR

(76) Inventor: Chia-Sheng Chang, No. 52, Feng Chang St., Nan Tun Dist., Taichung City (TW)

( * ) Notice: Subject to any disclaimer, the term of this patent is extended or adjusted under 35 U.S.C. 154(b) by 212 days.

(21) Appl. No.: 12/014,115

(22) Filed: Jan. 15, 2008

(65) Prior Publication Data

US 2009/0180825 A1 Jul. 16, 2009

(51) Int. Cl.
*A46B 11/04* (2006.01)
*A47L 13/22* (2006.01)

(52) U.S. Cl. ..... 401/281; 401/280; 401/283; 401/270; 401/269; 401/205

(58) Field of Classification Search ..... 401/281, 401/274, 280–284, 286, 287, 200, 205, 123, 401/124, 263, 265, 266, 196, 202, 207, 268–270, 401/290, 291; 132/298, 299
See application file for complete search history.

(56) References Cited

U.S. PATENT DOCUMENTS

| | | | | |
|---|---|---|---|---|
| 6,719,474 | B2 * | 4/2004 | Petit | 401/281 |
| 6,932,533 | B1 * | 8/2005 | Chen | 401/280 |
| 7,114,871 | B2 * | 10/2006 | Thiebaut | 401/205 |
| 2004/0120753 | A1 * | 6/2004 | Gieux | 401/200 |

* cited by examiner

*Primary Examiner*—Gregory L Huson
*Assistant Examiner*—Keegan Gumbs
(74) *Attorney, Agent, or Firm*—Leong C. Lei

(57) ABSTRACT

Disclosed is a quantitative discharge structure for a brushed cosmetic jar. The jar includes a receptacle that receives and stores powder cosmetic product therein and has a top opening to which a closing/opening seat formed by a stacking arrangement of upper and lower valve boards is mounted. An implanting seat of bristle bundles has a bottom forms a reservoir located above the opening/closing seat so that when the opening/closing seat opens, a predetermined amount of the cosmetic product is fed into the reservoir. And the cosmetic product is then discharge into the bristles for uniform and comfortable application.

2 Claims, 5 Drawing Sheets

QUANTITATIVE DISCHARGE STRUCTURE FOR BRUSHED COSMETIC JAR

BACKGROUND OF THE INVENTION (a) Technical Field of the Invention

The present invention relates to a quantitative discharge structure for a brushed cosmetic jars wherein an opening/closing seat formed of a stacking arrangement of upper and lower valve board is mounted to a top opening of a receptacle that receives a cosmetic product therein and a bristle seat has a bottom reservoir located above the opening/closing seat to selectively receive a predetermined amount of the cosmetic product from the receptacle when the opening/closing seat opens.

(b) Description of the Prior Art

A conventional brushed cosmetic jar has a construction as shown in FIGS. 7 and 8, comprising a hollow receptacle (30) having a U-shaped cross section for receiving therein a cosmetic product and having a top opening to which an inward-flanged cylinder (32) is mounted to secure a bristle seat (31) on the receptacle (30). The seat (31) is provided with a circumferential slot for mounting the bristles (33) and cosmetic discharge passages (34) extending therethrough to allow the cosmetic product stored in the receptacle (30) to flow into the bristles (33) for application when the jar tips. The outer circumference of the bristle seat (31) is fit with a slide tube (35) for bundling the bristles (33) when the bristles (33) is to be fixed together in order to allow for easy capping of a cover (36). Such a structure realizes easy brushing operation for makeup purposes. However, it is of a trouble that with a user's hand holding and tipping the jar, the cosmetic product contained in the jar is continuously discharged into the bristles (33) without stopping, making it impossible to control the amount of the cosmetic product discharged, thereby leading to a waste and an uncontrolled application of the cosmetic product. This is particularly troublesome at the time when a user attempts to make applied cosmetic uniform because the continuously discharged cosmetic makes it very difficult for the user to do that. Apparently, the conventional devices do not meet the needs for uniform application of cosmetic. The brush that is provided in the cosmetic jar is for easy application of the cosmetic and thus it would be very challenge to provide a brushed cosmetic jar that allows enhanced easiness and control of application of cosmetic. Such a challenge leaves the cosmetic product manufacturers with a gap to step over in the development and manufacturing of consumer appealing brushed cosmetic product.

SUMMARY OF THE INVENTION

The primary purpose of the present invention is to provide a brushed cosmetic jar that realizes quantitative discharge of cosmetic in a simple way, wherein an opening/closing board structure and a quantitative reservoir are provided to ensure quantitative discharge of cosmetic product and for effecting uniform brushing result to thus achieve the practical effectiveness of easy and safe use of cosmetic.

Having been a specialized cosmetic product developer and manufacturer, based on years' knowledge about the advantages/disadvantages of using the conventional cosmetic product, the inventor have spent a lot of effort in the development of new cosmetic device that alleviates the above discussed drawbacks of the conventional cosmetic product and in accordance with the present invention, a quantitative discharge structure for a brushed cosmetic jar is provided, which comprises an opening/closing switch formed of a stacking arrangement of upper and lower valve boards that is mounted to the underside of a bristle seat arranged in a central section of the cosmetic jar, which, together with a cosmetic reservoir formed in the bottom of the bristle seat for accommodating a predetermined quantity of cosmetic therein, allows only the quantity of cosmetic to be discharged during the progress of cosmetic application, realizing easy brushing and safety operation for quantitative application of cosmetic, and effectively overcoming the drawbacks of inconvenient application of cosmetic and non-uniform application of cosmetic that are caused by uncontrollability of the discharged quantity of the cosmetic during the application process.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
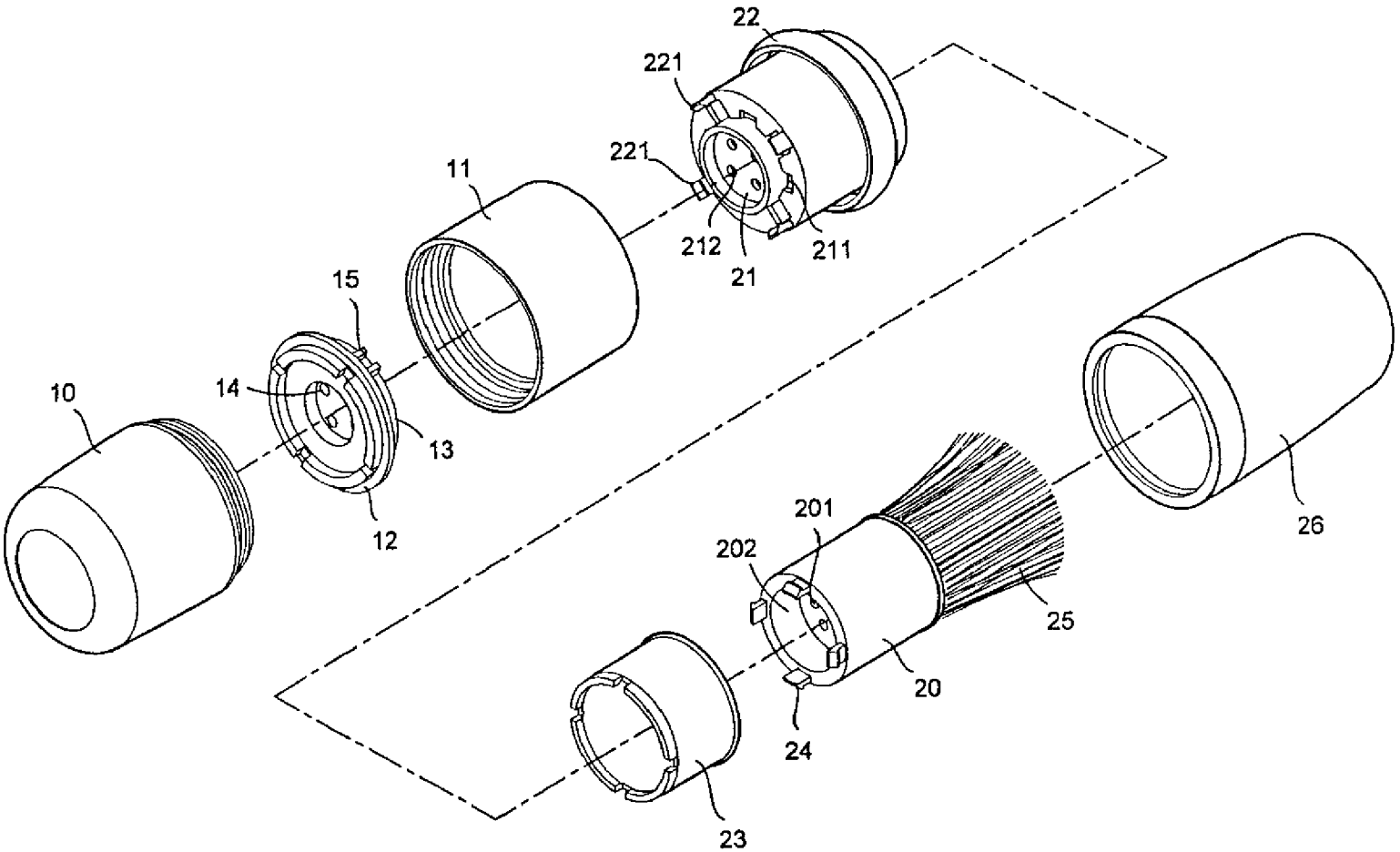
FIG. 1 is an exploded view of a brushed cosmetic jar constructed in accordance with the present invention.
Figure 2:
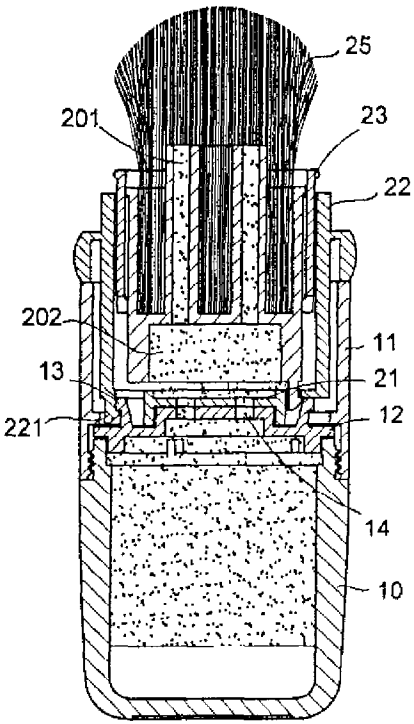
FIG. 2 is a cross-sectional view of the brushed cosmetic jar in filling a reservoir formed in a filament implanting seat with a predetermined amount of cosmetic.
Figure 3:
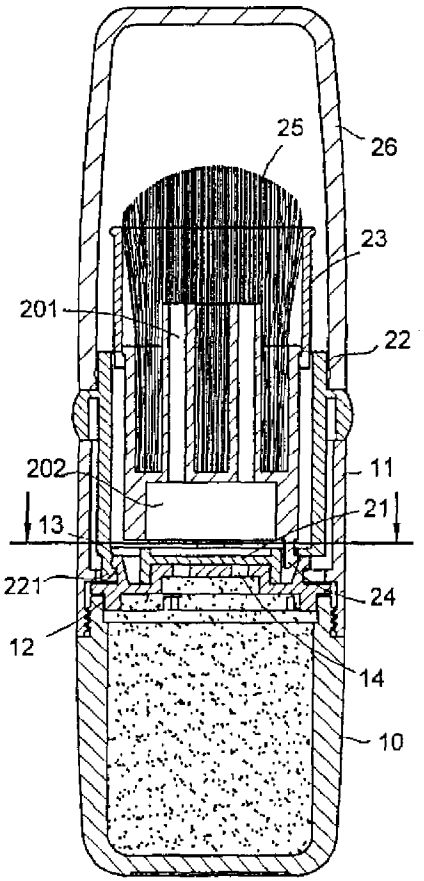
FIG. 3 is a cross-sectional view of the brushed cosmetic jar of the present invention.
Figure 5:
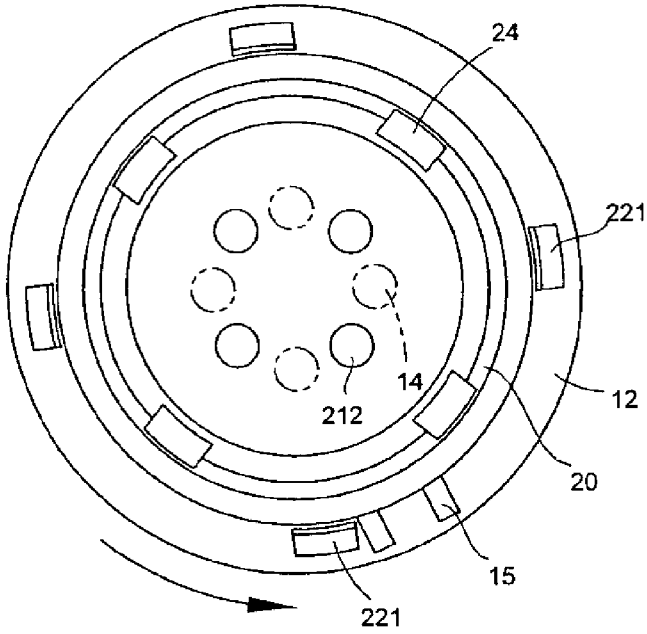
FIG. 5 is a cross-sectional view illustrating the closed condition of the valve boards of the brushed cosmetic jar of the present invention.
Figure 4:
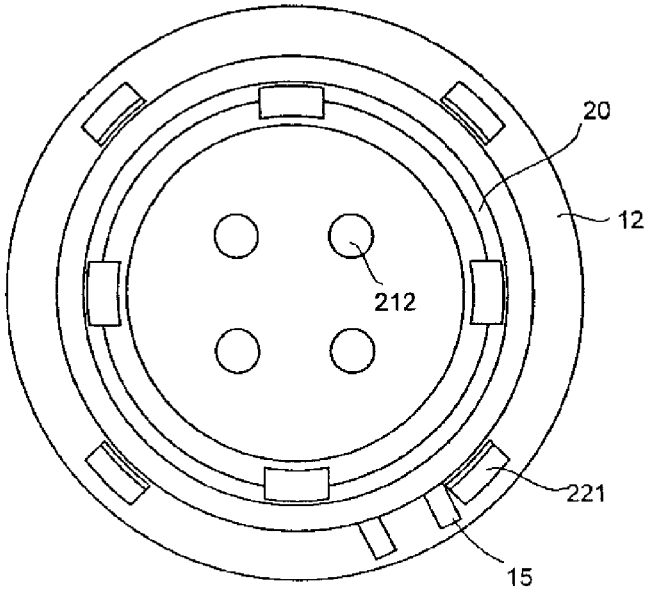
FIG. 4 is a cross-sectional view illustrating the open condition of the valve boards of the brushed cosmetic jar of the present invention.
Figure 6:
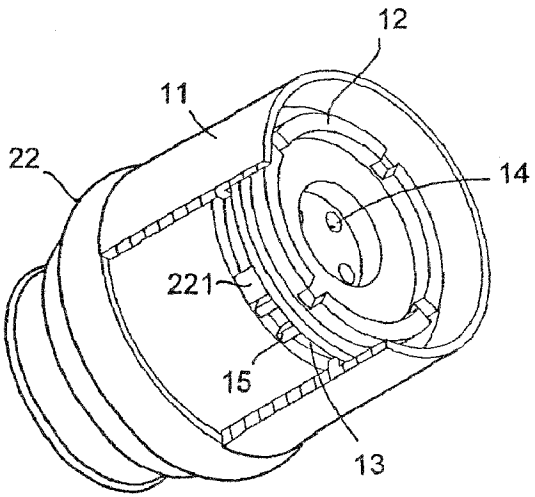
FIG. 6 is a perspective view of an assembly of a central cylinder and the filament implanting seat of the brushed cosmetic jar of the present invention.
Figure 8:
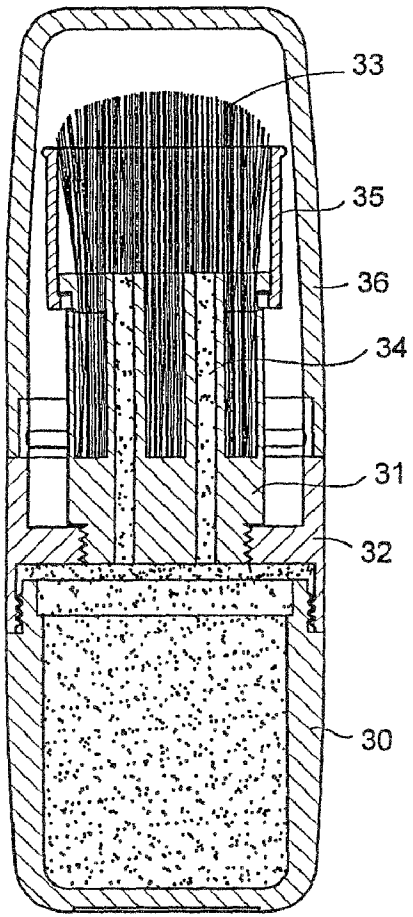
PRIOR ART FIG. 8
FIG. 8 is a cross-sectional view of the conventional brushed cosmetic jar.
Figure 7:
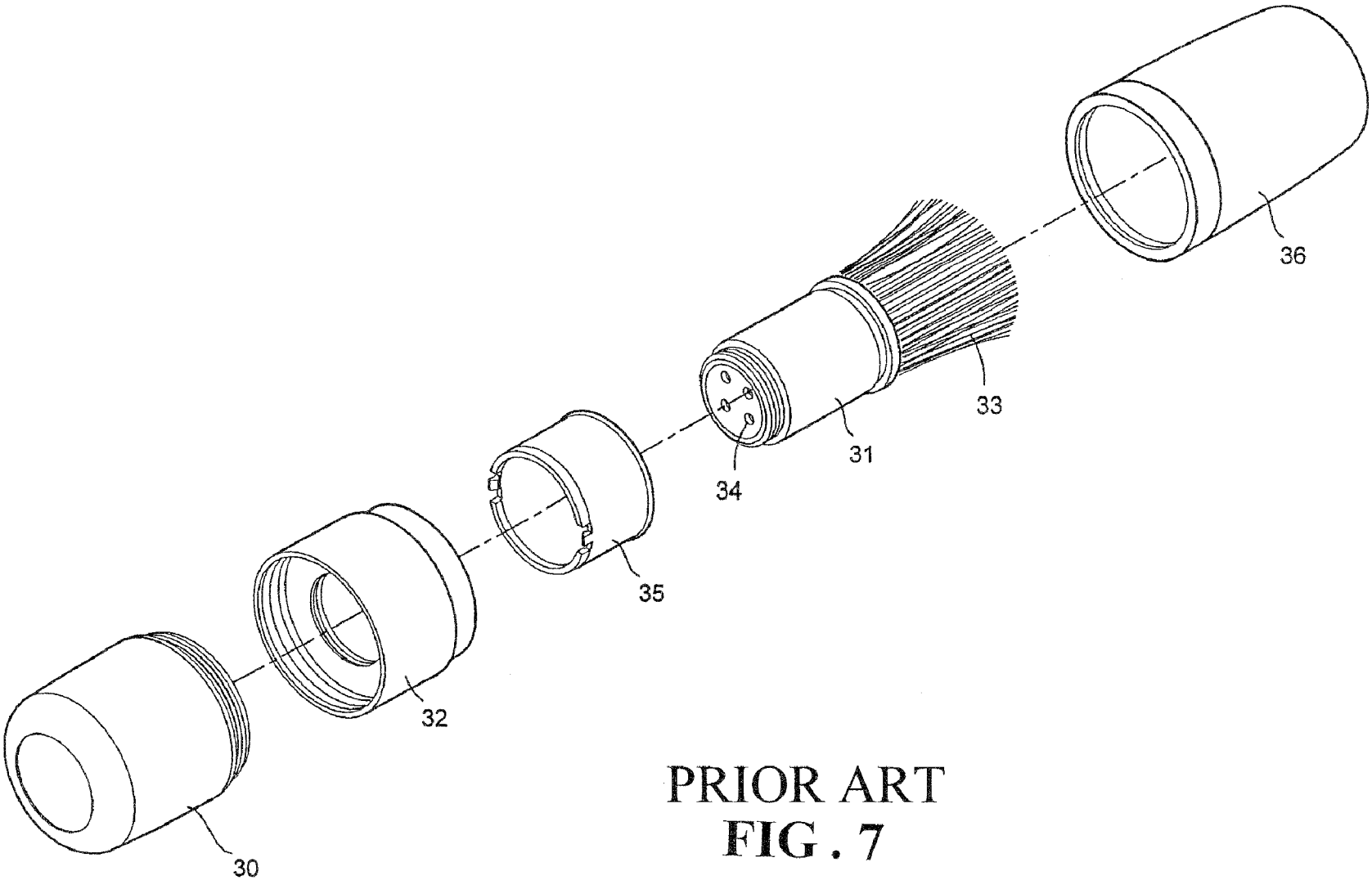
PRIOR ART FIG. 7
FIG. 7 is an exploded view of a conventional brushed cosmetic jar.

With reference to the drawings and in particular to FIGS. 1-6, the present invention provides a brushed cosmetic jar, which comprises a cosmetic product receiving receptacle (10), a central cylinder (11), a filament implanting seat (20), and a cover (26), which together form the cosmetic jar. The cosmetic product receiving receptacle (10) is made a hollow jar-like container having a U-shaped cross section, and can be made of glass or plastics, such as acrylic. The cosmetic product receiving receptacle (10) has an opening to which a lower valve board (12) is mounted and secured in position by the central cylinder (11). A rotatable control assembly, consisting of an upper valve board (21) and a rotation ring (22), is received in the central cylinder (11). A slide tube (23) is slidably fit into the rotation ring (22). The filament implanting seat (20) is received and fixed in the slide tube (23). The filament implanting seat (20) has a bottom from which penetration/retention tabs (24), preferably in barb form, project for directly fitting into and engaging with corresponding slots (211) defined in the upper valve board (21) that is formed on the bottom of the rotation ring (22) to thereby fixing the filament implanting seat (20) and the rotation ring (22) together. The filament implanting seat (20) holds on a top thereof a bundle of filaments (25), serving as a brush, in which passages (201) are formed and the filament implanting seat (20) also forms on a bottom thereof a recessed reservoir (202) which is in communication with the passages (201). The rotation ring (22) that receives and retains the brush therein forms, on the bottom thereof penetration/retention tabs (221), preferably in barb form, spaced along an outer circumference of the bottom, preferably in an equally spaced manner, for fitting to and engaging with an upward-raised circumferential flange (13) formed on a top of the lower valve board (12) that is located below the cylinder (11) to fix them together in a relatively rotatable manner. This completes a cosmetic discharge structure for the brushed cosmetic jar with the cover (26) removably fit thereover to complete the brushed cosmetic jar assembly.

The feature of the brushed cosmetic jar in accordance with the present invention resides in that the discharge of cosmetic product that stored in the jar is controlled by an overlapping arrangement of the upper and lower valve boards (21, 12), which respectively form therein through holes (212, 14) in such locations that with the rotation of the rotation ring (22) with respect to the central cylinder (11) to have positioning projections 15 formed next to the flange (13) selectively engaging and thus stopping the penetration/retention tabs (221) of the rotation ring (22), the through holes (212, 14) are selectively aligned with each other or offset from each other. Thus, the discharge of the cosmetic product stored in the cosmetic product receiving receptacle (10) can be simply controlled through the rotation operation. In the use of the brushed cosmetic jar, with the arrangement of the reservoir (202) formed in the bottom of the filament implanting seat (20), a predetermined amount of the cosmetic product stored in the cosmetic product receiving receptacle (10) can be first fed to the reservoir (20) and then the rotation ring (22) is rotated to have the through holes (212) of the upper valve board (21) shifted to offset with respect to the lower valve board (12) to effect a closing condition whereby quantitative discharge of the cosmetic product from the brushed cosmetic jar is realized. To do makeup operation, the amount of the cosmetic product that is contained in the reservoir (202) flows outward through the passages (201) with the progress of the makeup operation for carrying out initial coating of the cosmetic product at the beginning phase of the makeup operation. When the predetermined amount of the cosmetic product is completely discharged from the reservoir, the brush no longer receives the cosmetic product and may then serve to do finish brushing of makeup. In this way, the amount of cosmetic product applied can be controlled and the final result of makeup can be ensured and practical requirement for the makeup can be met. The design for quantitative discharge of cosmetic can be modified to accommodate different requirements for the amount of cosmetic discharged. In addition, the quantitative discharge control provided by the present invention provides assistance for closing discharge of cosmetic after the use thereof so that to close and store up the brushed cosmetic jar, the slide tube (23) is slidably moved upward to bundle and secure the circumference and position of the brush for facilitating capping the cover (26) from the outside for closing and facilitating convenience of stowing and carrying and use when a user is going outdoors and attempts to do makeup, providing the brushed cosmetic jar with practical effectiveness of convenience and comfortableness of use.

The design of the brushed cosmetic jar with quantitative cosmetic discharge in accordance with the present invention can provide a convenient way of makeup by using the control of proper and quantitative discharge of cosmetic to avoid over-application or non-uniform application of cosmetic caused by non-stop discharge of cosmetic product and is especially convenient for outdoor makeup operation. The present invention also makes the brushing makeup operation meeting the practical needs for the control of the cosmetic discharge can allow the bush to simply carry out finishing of makeup, truly making the makeup operation more uniform and beautiful. The whole structure of the present invention is formed by simple assembling of injection-molded parts without any modification of the outside configuration of the cosmetic jar thereby truly exhibiting the characteristics of being convenient to use. The rotate-to-discharge operation is very simple and does not have the problems of over-consuming of cosmetic product from the brushed cosmetic jar and non-uniform application of cosmetic so that practical effectiveness of unique comfortable tactility and uniform application of cosmetic of the brushed cosmetic jar can be maintained. The whole structure is of low manufacturing and assembling costs and is a very design of control structure for quantitative discharge of cosmetic for a brushed cosmetic jar that is rich of practical effectiveness.

Ton conclude, the quantitative discharge structure for brushed cosmetic jar in accordance with the present invention uses the central cylinder to retain the lower valve board, with the upper valve board and the filament implanting seat mounted to the rotation ring, to form a complete rotation control structure for cosmetic discharge, and with the quantitative discharge control realized by a pre-set reservoir, the brushing makeup operation can be effected with the practical convenience of makeup in the respect of being safe and quantitative, for further ensuring uniform and controlled application of cosmetic.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cosmetic jar comprising:

a cosmetic product receiving receptacle for receiving therein cosmetic product and having an opening;

a lower valve board mounted to said opening of said cosmetic product receiving receptacle, said lower valve board having a raised circumferential flange on a top of said lower valve board, a plurality of through holes, and positioning projections formed next to said flange;

a central cylinder threadedly engaged with said cosmetic product receiving receptacle to secure said lower valve board in position;

a rotation control assembly received in said central cylinder and consisting of an upper valve board and a rotation ring, said upper valve board having a plurality of through holes corresponding to said through holes of said lower valve board, said upper valve board further having a plurality of slots, said rotation ring being provided with a plurality of retention tabs spaced along an outer circumference of a bottom of said rotation ring;

a slide tube slidably fitted into said rotation ring;

a filament implanting seat received and fixed in said slide tube, said filament implanting seat having a bottom from which retention tabs project for directly fitting into and engaging with said slots of said upper valve board thereby fixing said filament implanting seat and said rotation ring together, a top of said filament implanting seat being provided with a bundle of filaments serving as a brush, said bottom of said filament implanting seat having a recessed reservoir having a bottom formed with a plurality of passages; and a cover removably fitted with said rotating ring;

wherein said recessed reservoir functions for quantitative preservation of cosmetic product by receiving a predetermined amount of said cosmetic product from said cosmetic product receiving receptacle in condition that said rotation ring is operated to align said through holes of said lower valve board with said through holes of said upper valve board, so that when said upper valve board is rotated to a closed location, said cosmetic jar is applicable for makeup operation with quantitative cosmetic discharge, and said slide tube is slidably moved upward to bundle and secure circumference and position of said filaments for facilitating capping said cover from outside for closing.

2. The cosmetic jar as claimed in claim 1, wherein said retention tabs of said rotation ring are arranged in an equally spaced manner.

* * * * *